United States Patent [19]

Hull

[11] Patent Number: 5,056,593

[45] Date of Patent: Oct. 15, 1991

[54] DEHUMIDIFYING HEAT EXCHANGER APPARATUS

[76] Inventor: Francis R. Hull, 567 E. 26th St., Brooklyn, N.Y. 11210

[21] Appl. No.: 501,274

[22] Filed: Mar. 29, 1990

Related U.S. Application Data

[63] Continuation-in-part of Ser. No. 232,672, Aug. 16, 1988, abandoned, which is a continuation-in-part of Ser. No. 878,184, Jun. 25, 1986, abandoned, which is a continuation-in-part of Ser. No. 772,909, Sep. 5, 1985, abandoned, which is a continuation-in-part of Ser. No. 654,236, Sep. 25, 1984, Pat. No. 4,548,262, which is a continuation-in-part of Ser. No. 480,930, Mar. 31, 1983, abandoned, which is a continuation-in-part of Ser. No. 237,909, Feb. 25, 1981, abandoned.

[51] Int. Cl.[5] ..... F28B 1/02

[52] U.S. Cl. ..... 165/111; 165/109.1; 165/900; 165/913

[58] Field of Search ..... 165/110, 111, 96, 913, 165/109.1, 900, 1

[56] References Cited

U.S. PATENT DOCUMENTS 1,451,334 4/1923 Ginabat ..... 165/913

4,548,262 10/1985 Hull ..... 165/913

*Primary Examiner*—Albert W. Davis, Jr.

[57] ABSTRACT

Dehumidifying heat exchanger apparatuses are disclosed in several variations which may economically condense and separate a potable water product from a humid air stream. Water product extraction yields may be substantially enhanced by new uses of electrostatic and magnetic fields. Liquid water droplets are electrostatically collected on grounded or charged heat transfer tubes in the heat exchanger apparatuses. In one variation, charged or grounded horizontally-declined heat transfer tubes with attached drainage wicks attract liquid droplets and accelerate condensing heat transfer by continuous absorption and transfer of condensate. Both cascading liquid droplets and aerosol injection of fine liquid droplets may be used to provide convenient seed nuclei for condensing attachment of water vapor molecules in other variations. Water vapor molecules may be electrostatically stabilized in a polar orientation between charged electrodes and oppositely-charged or grounded heat transfer tubes, then impelled by magnetic forces onto heat transfer surfaces as a thin condensing film. A simplified closed cycle heat transfer system is disclosed which may economically reject condensing heat to atmosphere. The heat exchanger apparatuses may operate with considerable energy economies, since substantial moisture separation may occur without any need to cool an entire air stream to below local saturation or dew point temperatures. Forms of the invention may collect potable water from humid air in water-short regions, dehumidify air in air conditioning apparatuses, separate out condensable vapor pollutants in air pollution control equipment and separate condensable vapors from gaseous fluids in chemical processes.

25 Claims, 6 Drawing Sheets

DEHUMIDIFYING HEAT EXCHANGER APPARATUS

RELATED APPLICATIONS

The present invention is a continuation-in-part of my presently pending application Ser. No. 232,672 entitled "Dehumidifying Heat Exchanger Apparatus" filed Aug. 16, 1988, now abandoned; which was a continuation-in-part of my prior application Ser. No. 878,184 entitled "Dehumidifying Heat Exchanger Apparatus" filed June 25, 1986 (abandoned); which was a continuation-in-part of my prior application Ser. No. 772,909 entitled "Dehumidifying Heat Exchanger Apparatus" filed Sept. 5, 1985 (abandoned); which was a continuation-in-part of my prior application Ser. No. 654,236 entitled "Condensing Gas-To-Gas Heat Exchanger" filed Sept. 25, 1984 (now U.S. Pat. No. 4,548,262); which was a continuation-in-part of my prior application Ser. No. 480,930 entitled "Condensing Gas-To-Gas Heat Exchanger" filed Mar. 31, 1983 (abandoned); which was a continuation-in-part of my prior application Ser. No. 237,909 entitled "Condensing Gas-To-Gas Heat Exchanger" filed Feb. 25, 1981 (abandoned).

BACKGROUND OF THE INVENTION

This invention relates to electrostatically-enhanced thin-film condensing gas-to-liquid heat exchangers in dehumidifying applications, and especially to their use for condensing potable water from humid atmospheric air in advance of natural precipitation. The invention includes means for substantially increasing condensate product yield, wherein humid atmospheric air is passed through a heat transfer section enveloped by an electromagnetic field. The invention also relates to separation of other condensable vapors from gaseous mixtures passing through ionizing heat exchanger apparatuses, where molecules of the condensable vapor have polar characteristics.

Natural rainfall is generally recognized as the precipitation of liquid drops of water released by condensing heat transfer, which occurs when warm moisture-bearing air masses are cooled by turbulent or convective mixing with colder air masses. Virtually all atmospheric moisture is thought to have originated from and been released by the evaporative solar heating of ocean waters. Water evaporated from ocean surfaces mixes with adjacent moving warm air masses, and is carried aloft by turbulence or convective air currents. Other atmospheric air currents derived from the earth's rotation, thermal effects of cyclic solar heating and fluid friction between the interfaces of moving air streams cause the movement of cool air masses away from colder regions of the earth's surface. The natural condensing process caused by the random mixing of cold air masses with moisture-bearing warm air masses is the principal mechanism of atmospheric precipitation, upon which much of life depends.

Usefulness of available land areas for sustaining plant and animal life is substantially limited by the random availability of natural precipitation. Many areas of the earth are plagued by drought, even when the local atmosphere may be relatively humid.

Air at any given temperature contains a limited amount of water vapor, which is a maximum at the saturation or dew point temperature. The water-vapor content or capacity of atmospheric air increases with rising temperature, and decreases as the air temperature falls. During the evening following a warm day, air that is nearly saturated with water vapor cools until it drops below the saturation temperature. As the air continues to cool, water vapor will condense onto any nearby cool surface as the air temperature drops below the dew point temperature, until a new saturation temperature is reached for the air-water vapor mixture.

The formation of single raindrops from the water vapors of clouds is only partly understood at this writing. Vapor condensation within clouds is commonly thought to develop by a nucleating process, when vapors condense onto available nucleating sites, such as surfaces of suspended particulates or moisture droplets. Intensive efforts by others to stimulate the release of atmospheric moisture into areas having deficient rainfall by dispersing chemical seed substances within clouds have had only limited success.

Dehumidification is a process for removing moisture from air or other gaseous fluids. A minor dehumidification of atmospheric air commonly occurs during the operation of air conditioning apparatuses, when an air stream is cooled below the dew point temperature of its water-vapor fraction. Condensation of atmospheric moisture onto the outer surfaces of exposed piping which carries a moving stream of water colder than the surrounding still air is a common phenomenon. The natural condensing process which precipitates atmospheric moisture to earth as rain, snow or sleet is but another form of dehumidification.

Dehumidification by cooling is commonly practiced in the arts related to comfort air conditioning. Typical air conditioning system operation requires that half or more of the cooling energy load be used to sensibly cool a moving mass of air and water vapor at a constant specific humidity, before any condensation of water vapor may commence. The moving mass of air and water vapor is further cooled and water vapor is removed from the air by condensing heat transfer surfaces, until a desired specific humidity is achieved. The moving mass of air and water vapor at the desired specific humidity must often be reheated to a desired temperature, before its discharge into an occupied space. An important purpose of this invention is to provide dehumidifying means which can substantially decrease the cooling energy and heating energy loads of air conditioning systems.

Condensation of diffuse vapors from large volume gaseous streams ordinarily requires that the entire gaseous stream be cooled below the saturation temperature for the partial pressure of the condensable vapor fraction. The economic separation of diffuse condensable vapors from large volume gaseous streams with substantially reduced energy requirements is an important goal of this invention, especially where molecules of the condensable vapor fraction have polar characteristics.

The invention may be used to dehumidify and extract potable water from atmospheric air in areas where an adequate supply of cooling water is unavailable. Such usage requires development of economical new cyclic means for rejecting absorbed heat from the condenser tubes of the heat exchanger apparatuses. The successful development of dehumidifying heat exchanger apparatuses having self-contained cyclic means of heat rejection would free mankind from its historic dependence on the random availability of water derived from the processes of natural precipitation.

While the apparatuses of the invention are largely described in connection with electrostatically-enhanced thin-film condensation of atmospheric water vapor onto cooler surfaces of heat transfer conduits within a heat exchanger enclosure, it will be understood by those skilled in the heat exchanger arts that variations of the condensing heat transfer apparatuses and methods described hereinafter may be employed advantageously in the design of other related electrostatically-enhanced heat exchanger apparatuses without departing from the scope of the invention.

As used herein:

The term 'fluid' shall refer to any liquid or gaseous medium.

The term 'single-pass' shall relate to a one directional passage of a fluid stream through a heat exchanger.

The term 'wick' shall apply to an elongate woven fibrous braid or other absorvent cellular composition which absorbs and transfers liquid from one point to another by means of capillary attraction or by hydrostatic pressure effects.

The term 'wicking distance' shall refer to the projected vertical distance between higher and lower levels of a wicking system ower which hydrostatic pressure effects complement the forces of capillary attraction to accelerate the internal drainage of absorbed liquids.

The term 'electrostatic enhancement' shall relate to a system of charged electrodes disposed between heat transfer conduits of a heat exchanger which electrostatically impels condensate onto surfaces of the heat transfer conduits.

The term 'thin-film' shall apply to a concentrated fluid film adjacent the surface of a heat transfer conduit.

The term 'electromagnetic field' shall refer to lines of force emanating from a ferromagnetic body enveloped by an electric coil, when an electrical current flows through the coil.

The primary object of the invention is to develop improved heat exchanger configurations which economically separate and condense water vapors from a humid air stream passing through a heat exchanger.

Another important object is to provide means for concentrating diffuse water vapors onto condensing heat transfer conduits as a humid atmospheric air stream passes through a heat exchanger.

An additional object is to provide means for enhancing the formation of liquid droplets from water vapors, within an atmospheric air stream passing through a heat exchanger.

A further object is to develop electromagnetic means which physically impel water vapor molecules onto condensing surfaces of a heat exchanger, while polar axes of the water vapor molecules are electrostatically oriented between charged electrodes and grounded heat transfer conduits.

Yet another object is to develop heat exchanger means which may condense and separate other condensable vapors from large volume gaseous streams.

With the foregoing objects in view, together with others which will appear as the description proceeds, the invention resides in the novel assembly and arrangement of cooperating gas-to-liquid condensing heat exchanger elements, cooling means, ionizing and electromagnetic means which will be described fully in the specification, illustrated in the drawings, and defined in the claims.

PREFERRED EMBODIMENTS

Figure 6:
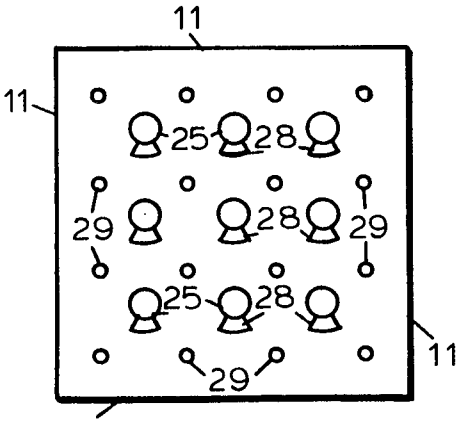
FIG. 6 is a transverse sectional view of the heat exchanger structure of FIGS. 1 and 2, showing a relative arrangement of charged electrode members and heat transfer tubes within the enclosure.

The illustrative embodiments of FIGS. 1–4 inclusive and FIG. 6 depict elements of a single-pass water-cooled air-to-water heat exchanger of the crossflow type. Heat transfer tubes 25 have elongate absorbent drainage wicks 28 attached to their lower portion within the heat exchanger enclosure, to absorb and drain condensate away from the tubular heat transfer surfaces. The heat exchanger is mounted so that its heat transfer tubes 25 are horizontally declined, to facilitate condensate drainage through wicks 28.

Condensing out diffuse water vapors from a moving mass of air ordinarily requires a sensible cooling of the entire gaseous stream to the water vapor dew point temperature, before condensation can begin. The total pressure of the gaseous mixture equals the sum of the partial pressure of dry air plus the partial pressure of the water vapor at the temperature of the mixture, in accordance with Dalton's Law of Partial Pressures. Absent means for concentrating water vapors adjacent the heat transfer surfaces, substantial dehumidification requires cooling the entire gaseous mixture to a new dew point temperature for a selected new specific humidity. The foregoing statement implies large cooling energy requirements for conventional air conditioning systems, where substantial dehumidification of a humid air stream is required.

Figure 19:
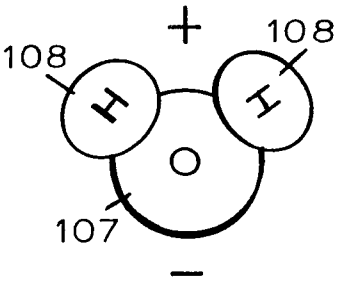
FIG. 19 is a schematic view of a water vapor molecule, showing its strongly polar regions.

A water vapor molecule exhibits strong di-polar characteristics, as indicated in FIG. 19. Hydrogen atoms are unsymmetrically joined to the oxygen atom by covalent bonding forces, with an included angle between hydrogen nuclei of about 105°. Water vapor molecules in a humid air stream passing through the heat exchanger apparatus may be regarded as comprising a swarm of minute di-polar magnets.

An uncondensed water vapor molecule passing between a charged elongate conductor and a grounded heat transfer tube would be momentarily stabilized by electrostatic forces, so that its polar axis is substantially oriented between the electrode and the nearest surface point of the adjacent heat transfer tube. If heat transfer tubes and charged elongate electrodes are symmetrically arranged within an elongate ferromagnetic conduit wrapped by an electric field coil (a tubular solenoid), a strong magnetic field having its greatest flux density along the central longitudinal axis of the tubular electromagnet would exist when the coil is energized. Water vapor molecules momentarily stabilized against tumbling by electrostatic forces between conductors and grounded heat transfer tubes would be impelled by magnetic forces across fluid flow streamlines onto the surface of adjacent heat transfer tubes, to form a thin condensing film thereupon.

A minor fraction of product water will be recirculated and injected into the inlet air stream as a fine aerosol of water droplets, to provide seed nuclei for the condensation of water vapors in the heat exchanger apparatus. Electrostatic forces will be utilized in the apparatus of the invention to impel fine water droplets onto grounded heat transfer tubes. Uncondensed water vapor molecules will be momentarily held in polar orientation between electrodes and grounded heat transfer tubes, so that they may be acted upon by magnetic forces. Forces of magnetic repulsion will be utilized to impel uncondensed water vapor molecules onto adjacent grounded heat transfer tubes as a thin condensing film, to substantially increase the water product yield of the apparatus of the invention.

In the condensing heat exchanger structure of FIGS. 1–7 inclusive, enclosure 11 includes top, bottom, side and end walls. The bottom panel is shaped to enclose a drainage well 18 at its left-hand end, to receive the drainage flow of condensed water that is discharged at 19. The heat exchanger is vertically supported by legs 20 and 21, so that its heat transfer tubes 25, absorbent drainage wicks 28, and the bottom panel of enclosure 11 are horizontally declined, to facilitate condensation absorption and drainage.

Atmospheric air enters through air inlet housing 12 and filter 13, and is induced to flow through the heat exchanger by the operation of motor-driven exhaust fan 15. Exhaust fan 15 is suitably mounted within air inlet housing 14. Entering air flows across heat transfer tubes 25 in three shell passes, as it courses around partial shell baffles 17 and 16 before discharge by exhaust fan 15. Exhaust fan 15 is normally operated at low-to-moderate speeds, so that moderate air velocities occur within the heat exchanger.

Pressurized cooling water flowing within the plurality of heat transfer tubes 25 is supplied from pump 22, or any other suitable supply source. Pump 22 may be the supply pump of a municipal water system, or any separate pump supplying cooling water from the ocean, a lake, river or other source of cooling water.

Cooling water flows into the suction of pump 22, and is discharged through supply pipe 23. Supply pipe 23 communicates with distribution piping 24, whose outlets communicate with the inlet ends of heat transfer tubes 25. The pressurized cooling water supplied by pump 22 flows through heat transfer tubes 25 and into the inlets of collection piping 26. Collection piping 26 communicates between the outlet ends of heat transfer tubes 25 and discharge pipe 27. Discharge pipe 27 may be connected to the domestic water supply piping of a building, or discharge to elements of any other domestic water supply system. Discharge pipe 27 may also discharge the cooling water back into a lake, river, the ocean, etc, when the water is used only for cooling.

As shown if FIGS. 1,3,4 and 6, portions of heat transfer tubes 25 within enclosure 11 each have an elongate absorbent drainage wick 28 attached to its lower outer surface. Condensate collected on the outer surfaces of tubes 25 drips into and is absorbed by drainage wicks 28. The absorbed condensate is inwardly confined within wicks 28 by capillary attraction, and impelled to flow downwardly through the horizontally-declined drainage wicks by hydrostatic pressure to the lower wick endings (as illustrated at the lower left-hand side of FIGS. 1 and 4). The wick condensate drainage falls into drainage well 18 within enclosure 11, and is discharged from heat exchanger through outlet 19. Water discharged from heat exchanger outlet 19 is ordinarily potable, and can be channeled into a suitable reservoir for domestic use.

The disposition of absorbent drainage wicks 28 beneath tubes 25 in this variation of the invention is intended to prevent the large-scale cascadng of condensate droplets from upper tube members 25 onto lower tube members 25 within the enclosure. Cascading of condensate droplets onto the surfaces of lower tube members 25 could otherwise slow the transfer of heat energy from the water vapor fraction of the air-water vapor mixture to the cooling water within tubes 25, and reduce the effectiveness of the heat exchanger.

Heat transfer tubes 25 can be formed of stainless steel or other suitable corrosion-resistant material. Tubing thickness should be selected adequately for the intended pressure of the cooling water service system.

Figure 3:
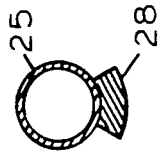
FIG. 3 is a transverse sectional view of a condensing heat exchanger tube, having a lower absorbent drainage wick attached thereto.
Figure 1:
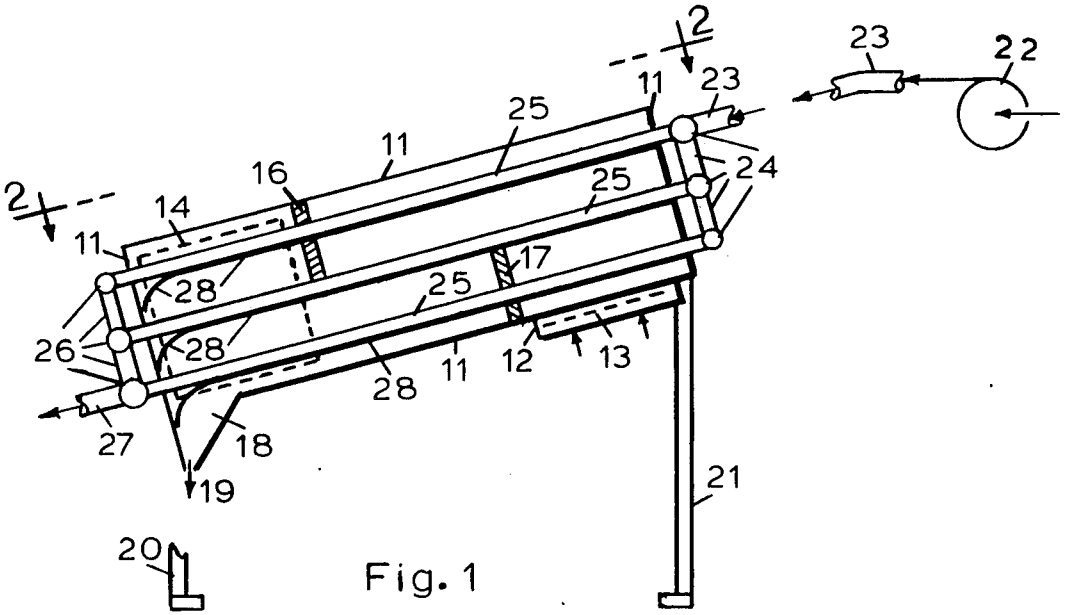
FIG. 1 is a sectional longitudinal elevation of a simplified variation of the invention which comprises a condensing gas-to-liquid heat exchanger of the crossflow type having elongate absorbent drainage wicks disposed along the underside of horizontally-declined heat transfer conduits, which is taken along offset line 1—1 of FIG. 2.
Figure 2:
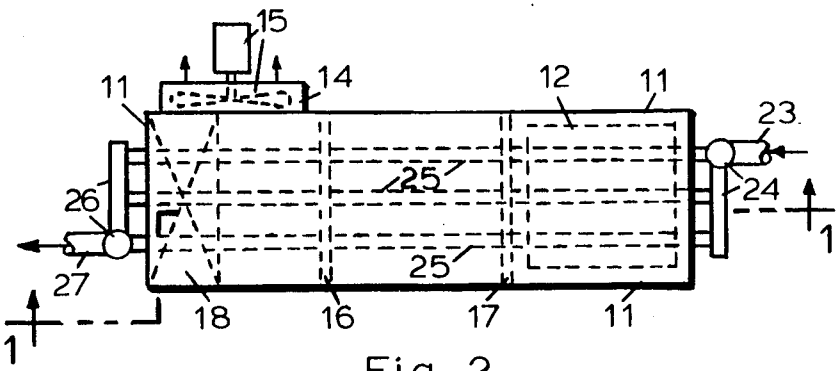
FIG. 2 is a plan view of the heat exchanger variation, taken along line 2—2 of FIG. 1.
Figure 5:
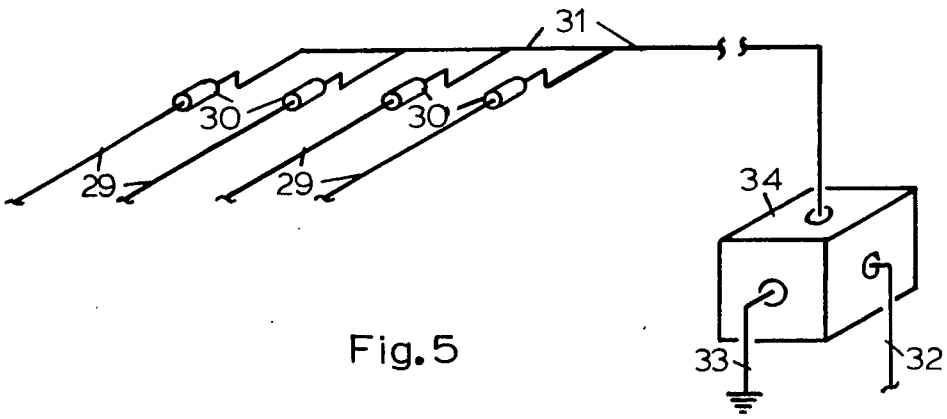
FIG. 5 is a partial isometric schematic diagram of an ionizing electrical system, whose electrode members are disposed between and adjacent heat transfer conduits to electrostatically impel condensate droplets onto the tubular heating surfaces, while a gaseous stream is passing through a heat exchanger.
Figure 4:
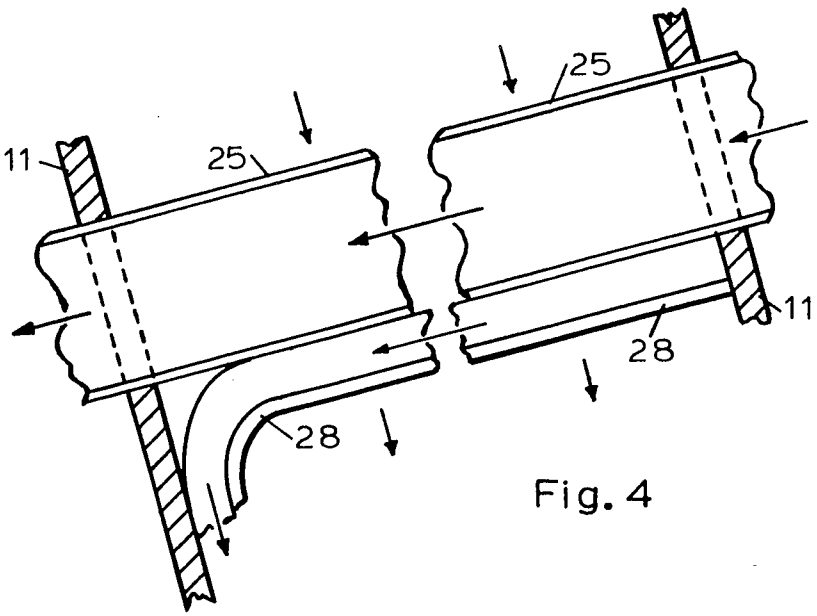
FIG. 4 is an enlarged longitudinal sectional elevation of a condenser tube with attached absorbent drainage wick, as disposed within the heat exchanger enclosure of FIG. 1.

FIG. 5 is a partial isometric schematic diagram of a parallel array of charged electrode wires 29 disposed in a laterally-spaced arrangement (as between tubes of a heat exchanger). Charged electrode wires 29 are supplied with rectified electrical current by way of common high-voltage bus or conductor 31 from exterior rectifier 34. Rectifier 34 is supplied with alternating current from a suitable source by way of supply conductor 32, and is connected to ground via conductor 33. Electrode wires 29 are provided with insulating connectors 30 where they enter the walls of enclosure 11. All elements of FIG. 5 are common to the electrical precipitator arts.

FIG. 6 illustrates a cross section of the heat exchanger where laterally-spaced heat transfer tubes 25 have absorbent drainage wicks 28 attached to their lower portion, and charged electrode wires 29 are disposed between and around tubes 25. The arrangement of charged electrode wires 29 is intended to electrostatically impel fine water droplets onto surfaces of condenser tubes 25, as the air-and-water vapor mixture passes through the heat exchanger. Electrode wires 29 may be either positively or negatively charged, although negative charging may be preferable in most uses.

Figure 7:
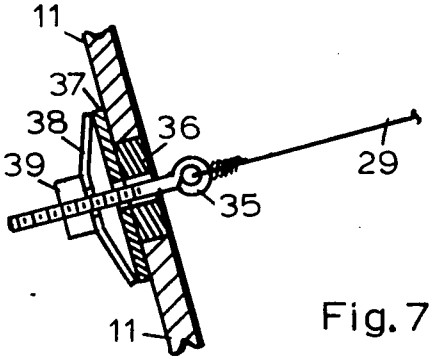
FIG. 7 is a fragmentary sectional view of an electrode wire connecting assembly, which is used to keep electrode wire members taut between opposite walls of the heat exchanger enclosure.

FIG. 7 discloses a sectional view of a connector assembly which may be used to keep electrode wires 29 taut when they are disposed between tubes 25. Electrode wire 29 is attached to threaded eyebolt 35 as shown. Eyebolt 35 extends through a central void of insulating disc 36, which is seated in an opposite endwall of enclosure 11 from connector 30. Eyebolt 35 threads into nut 39, which bears against the central area of coned-disc spring 38. Coned-disc spring 38 is disposed to bear against insulating washer 37 at the lower outer edges of the spring, while insulating washer 37 rests against the endwall of enclosure 11. When thread nut 39 is tightened onto eyebolt 35, tension on both coned-disc spring 38 and electrode wire 29 is increased. Electrode wire tension is then maintained by coned-disc spring 38.

In the electrostatically-enhanced heat exchanger structure of FIGS. 8–11 inclusive, enclosure 40 includes confining top, bottom, side and end walls. Bottom panel 47 of enclosure 40 is obliquely declined to facilitate condensate drainage, and its left-hand end is shaped to enclose a drainage well 48 having condensate outlet 49. The heat exchanger is normally supported by standing legs or vertical hangers, so that its top panel is horizontally oriented. Condensate dripping downwardly off upper tube members 52 of the arrangement is allowed to cascade onto heating surfaces of lower tube members 52 in this variation.

Atmospheric air enters through air inlet housings 41 and filters 42, which are located in opposite sidewalls at the right-hand end of the heat exchanger enclosure. Air is induced to flow through the enclosure 40 by the operation of motor-driven exhaust fan 44. Exhaust fan 44 is suitably mounted within air outlet housing 43, which is located in a sidewall at the left-hand end of the heat exchanger enclosure. Entering air flows across heat transfer tubes 52 in three shell passes, as it courses around partial shell baffles 46 and 45 before discharge by exhaust fan 44. Exhaust fan 44 is normally operated at low-to-moderate speeds, to develop moderate air velocities within the heat exchanger.

Pressurized cooling water from any suitable supply source enters the heat transfer piping through supply pipe 50. The pressurized cooling water flows from supply pipe 50 into distributing box header 51, whose outlets communicate with the inlets of the plurality of heat transfer tubes 52. The cooling water flows through tubes 52, and into the inlets of collecting box header 53. An outlet of collecting box header 53 communicates with the inlet of discharge pipe 54, as shown. Discharge pipe 54 may be connected to the domestic water supply piping of a building, or other domestic water supply system. Discharge pipe 54 may also discharge the cooling water back into a lake, river, the ocean, etc. when the water is used only for cooling.

Figure 8:
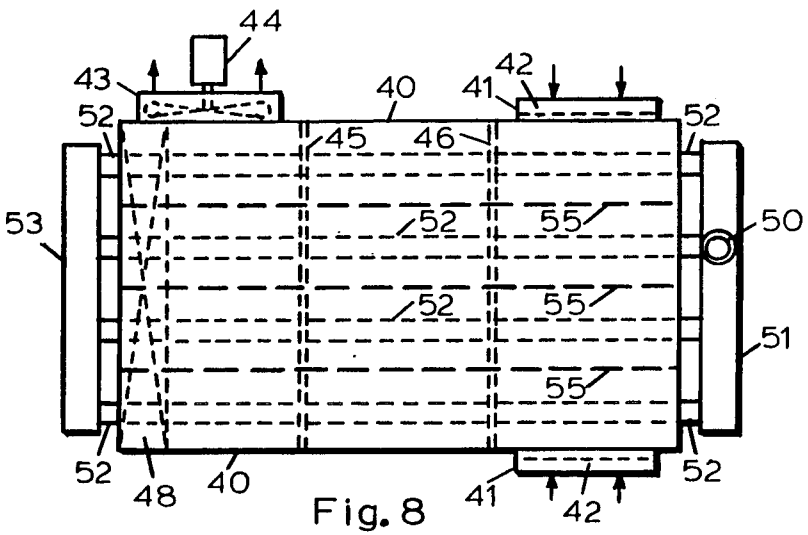
FIG. 8 is a plan view of another heat exchanger variation, which differs from the embodiments of FIGS. 1–7.
Figure 9:
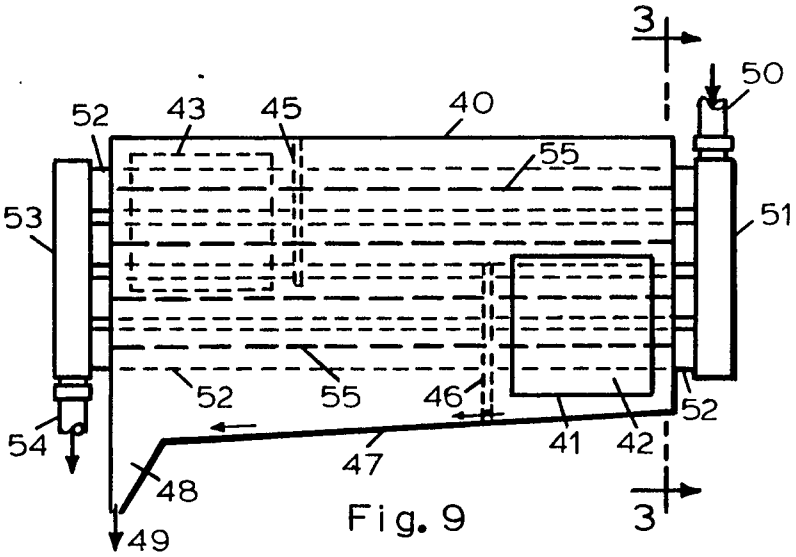
FIG. 9 is a side elevation of the heat exchanger structure of FIG. 8.
Figure 11:
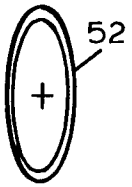
FIG. 11 is a transverse sectional view of an elliptical heat transfer tube shape.
Figure 10:
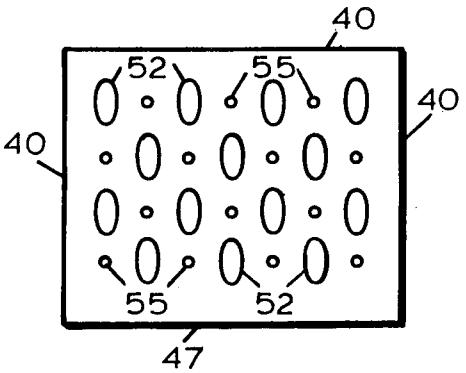
FIG. 10 is a transverse sectional view taken along line 3—3 of FIG. 9, showing the relative arrangements of charged electrode members and heat transfer tubes within the enclosure.

Charged electrode wires 55 are disposed in a spaced arrangement between and adjacent tubes 52 within enclosure 40, as shown in FIGS. 8, 9 and 10. The charged electrode wires 55 are supplied with electrical current at a suitable amperage and voltage from an exterior electrical supply system, such as discussed heretofore in connection with FIGS. 5 and 7. The arrangement of electrode wires 55 with respect to tubes 52 within enclosure 40 is intended to electrostatically impel fine water droplets onto surfaces of tubes 52, and water droplets drained from tubes 52 to cascade downwardly within enclosure 40 may provide nucleating sites for the condensation of water vapors.

Figure 12:
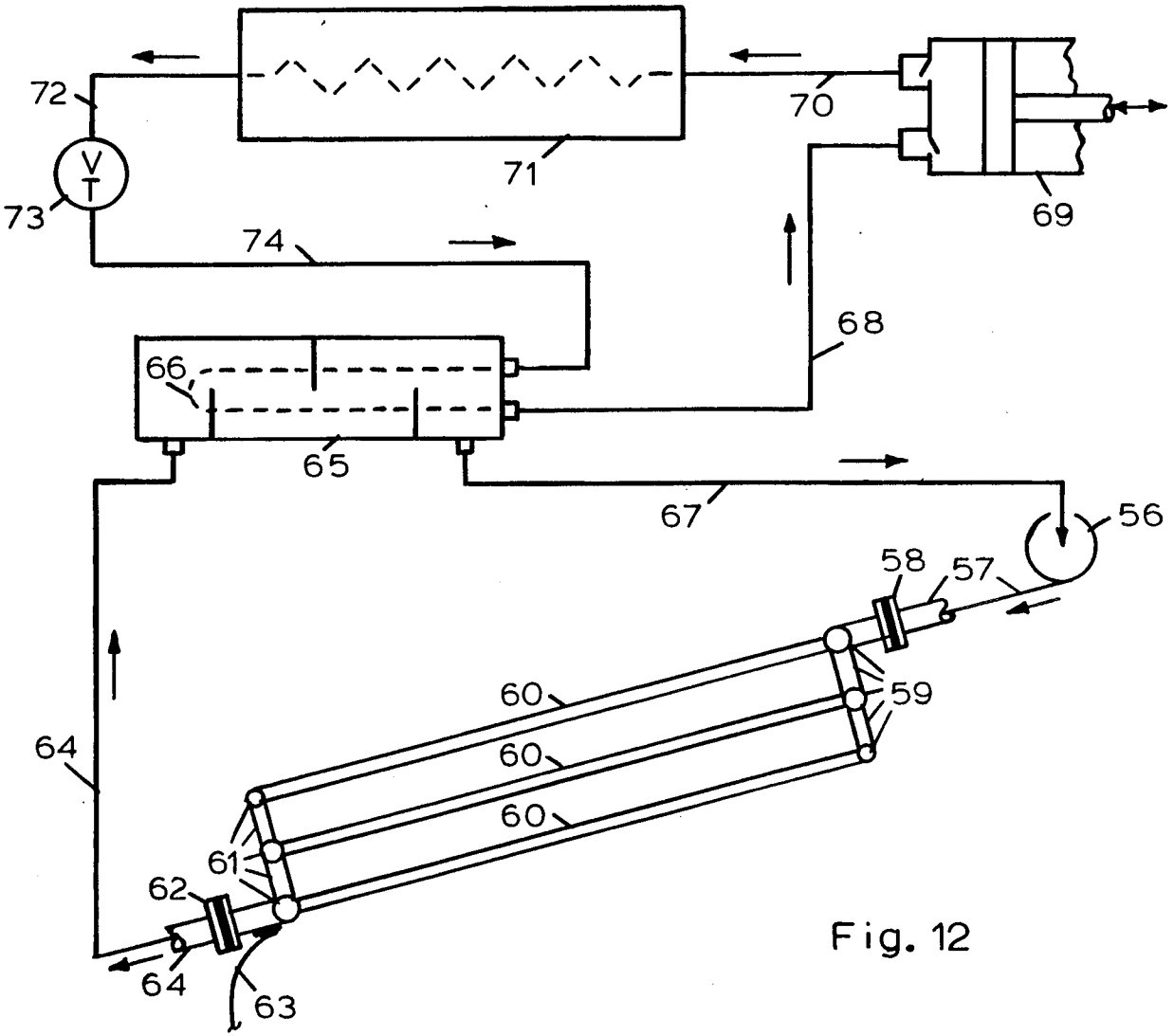
FIG. 12 is a simplified schematic diagram of a heat transfer cycle wherein the cooling fluid flowing through the heat transfer tubes is circulated through and cooled by the evaporative heat exchanger of an exterior vapor compression refrigeration system, which enables the dehumidifying heat exchanger apparatus to function independently of any available exterior supply of cooling fluid.

The simplified schematic of the cyclic heat transfer system disclosed in the embodiment of FIG. 12 is comprised of two complementary thermodynamic cycles:

(a) A lower heat transfer cycle wherein a fluid pump circulates a suitable working fluid through heat transfer tubes of the dehumidifying heat exchanger and through shell-side passageways of an evaporator heat exchanger. Heat absorbed by tubes of the dehumidifying heat exchanger is transferred into the shell of an evaporator heat exchanger, and rejected from the lower cycle as energy is absorbed by a suitable fluid refrigerant which is the working fluid of the upper vapor compression refrigerator cycle.

(b) An upper vapor compression refrigerator cycle wherein a suitable fluid refrigerant is vaporized by absorbing heat in an evaporator heat exchanger, pressurized on passage through a suitable compressor, condensed to liquid as heat is rejected to atmosphere on passage through a suitable condenser heat exchanger, and expanded to a lower pressure as the fluid refrigerant passes through a suitable throttle valve.

In the lower heat transfer cycle of FIG. 12, a suitable heat transfer fluid enters the inlet of circulating pump 56 from conduit branch 67. Circulating pump 56 discharges the pressurized working fluid into distribution conduits 59 by way of conduit branch 57. Conduit branch 57 includes insulating flanges 58, which electrically isolates downstream heat transfer tubes 60 of the dehumidifying heat exchanger from upstream sections of conduit branch 57.

The lower-cycle heat transfer fluid flows from outlets of distribution conduits 59 into communicating inlets of heat transfer tubes 60. The heat transfer fluid flows thru heat transfer tubes 60, where heat is absorbed as vapors condense onto their outer surfaces. The heat transfer fluid discharged from outlets of tubes 60 flows into communicating inlets of collection conduits 61. The heat transfer fluid is discharged from collection conduits 61, and flows into conduit branch 64. The lower portion of conduit branch 64 includes insulating flanges 62, which electrically isolates upstream heat transfer tubes 60 of the dehumidifying heat exchanger from downstream portions of conduit branch 64.

Electrical conductor 63 is connected to conduit branch 64 upstream of insulating flanges 62 as shown. Conductor 63 may be either connected to an electrical ground, or charged to an electrical potential of opposite polarity from that of charged electrode wires on the shell-side of the dehumidifying heat exchanger. Heat transfer tubes 60 and conduits 59 and 61 between insulating flanges 58 and 62 are electrically conducting, so that heat transfer tubes 60 become electrostatic droplet collectors when the dehumidifying heat exchanger apparatus is operating.

The outlet of conduit branch 64 communicates with the shell-side inlet of evaporator heat exchanger 65. The lower cycle heat transfer fluid flows from conduit branch 64 into shell-side fluid passageways of evaporator heat exchanger 65, and is discharged from evaporator heat exchanger 65 by way of a suitable outlet. The shell-side outlet of evaporator heat exchanger 65 communicates with the inlet of circulating pump 56 via conduit branch 67, to complete the lower-cycle heat transfer circuitry.

The upper vapor compression refrigerator cycle is common in the refrigerator arts, save for joint use of the evaporator heat exchanger 65 with the lower heat transfer cycle. A plurality of internal 2-pass heat transfer tubes 66 is disposed within evaporator heat exchanger 65, which absorb heat from the lower heat transfer cycle which vaporizes a low-pressure fluid refrigerant flowing therewithin.

Low-pressure fluid refrigerant enters the head-end inlet of evaporator heat exchanger 65 from conduit branch 74. The fluid refrigerant flows through the internal fluid passageways of the plurality of heat transfer tubes 66, and is vaporized by the heat energy absorbed through the tube sidewalls. Vaporized fluid refrigerant is discharged from the head-end outlet of evaporator heat exchanger 65, and flows into the valved inlet of compressor 69 via communicating conduit branch 68.

Compressor 69 is schematically illustrated as a reciprocating compressor type. Compressor 69 may be any common compressor type such as reciprocating, centrifugal, axial, sliding vane, etc. which is suitable for use with vapor compression refrigerator systems.

Vapors of the fluid refrigerant are pressurized by compressor 69, and discharged from its valved outlet into communicating conduit branch 70, which also communicates with an inlet of condenser heat exchanger 71. Pressurized vapors of the fluid refrigerant flow from the valved outlet of compressor 69 into internal fluid passageways of condenser heat exchanger 71, and are condensed to liquid therewithin. Condenser heat exchanger 71 may transfer heat directly to atmosphere when it is air cooled, to cooling water when it is water cooled, or alternately reject heat to any other suitable heat transfer apparatus.

Pressurized liquid refrigerant is discharged from an outlet of condenser heat exchanger 71 into communicating conduit branch 72, and flows into the inlet of throttle valve 73. The refrigerant pressure is substantially reduced as it flows past the internal resistance of throttle valve 73.

A low-pressure mixture of liquid-and-vapor refrigerant is typically discharged from the outlet of throttle valve 73 into communicating conduit branch 74. The liquid-vapor mixture of fluid refrigerant flows from conduit branch 74 into the head-end inlet of evaporator heat exchanger 65, and flows thence through the plurality of heat transfer tubes 66 disposed therewithin. As the fluid refrigerant flows through tubes 66, vaporization of the liquid fraction is completed as the refrigerant absorbs heat transferred into evaporator heat exchanger 65 from the lower heat transfer cycle.

The upper vapor compression refrigerator cycle of FIG. 12 may utilize any suitable fluid refrigerant as the cycle working fluid. The lower heat transfer cycle of FIG. 12 may use any heat transfer fluid having suitable properties as the cycle working fluid.

Figure 15:
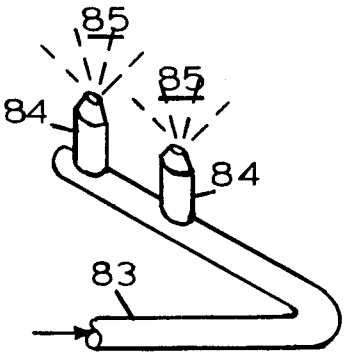
FIG. 15 is a fragmentary isometric view of pressurized supply conduit and hydraulic atomizing nozzles which are disposed within the air inlet section of the heat exchanger of FIGS. 13 and 14, which discharges a finely dispersed water aerosol or fog into the heat exchanger.
Figure 13:
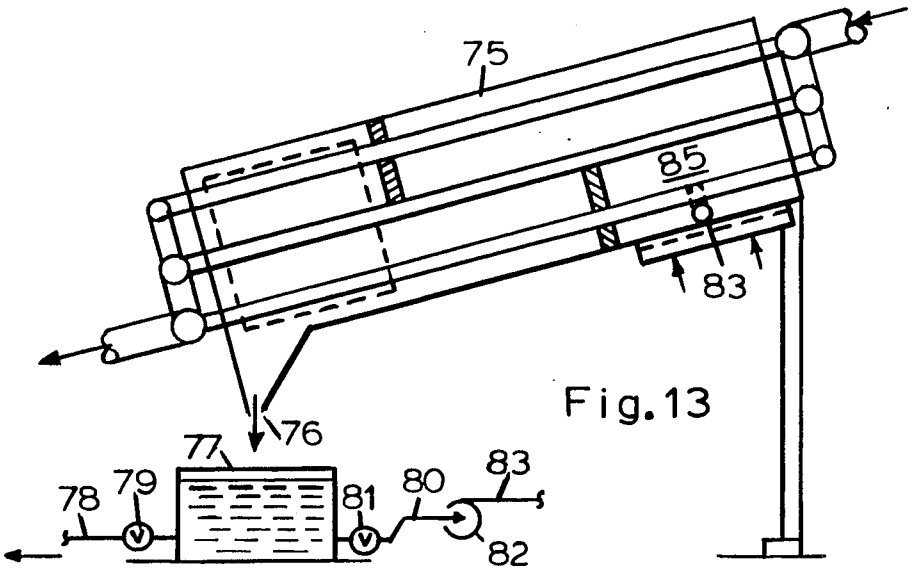
FIG. 13 is a sectional longitudinal elevation of a heat exchanger enclosure similar to the embodiments of FIGS. 1, 2 and 6 wherein a minor fraction of the liquid condensate discharged from the apparatus is recirculated through hydraulic atomizing nozzles, which are disposed within the air inlet section of the heat exchanger.
Figure 14:
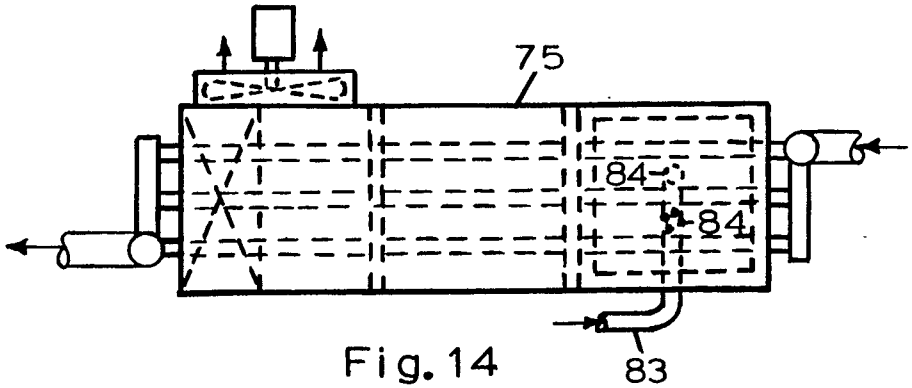
FIG. 14 is a plan view of the heat exchanger apparatus of FIG. 13.

The embodiments of FIGS. 13, 14 and 15 disclose means for injecting a nucleating aerosol of cooled finely-dispersed water droplets into the air inlet section of a dehumidifying heat exchanger. The nucleating aerosol of fine water droplets is slightly cooled by evaporation, when a recirculated minor fraction of product water is pressurized by a small pump and expanded through hydraulic atomizing noddles disposed within an inlet zone of the heat exchanger. Minute water droplets of the cool aerosol provide convenient nuclei for the attachment onto and condensation of water vapor molecules from the atmospheric air stream passing through the heat exchanger. The effect of injecting the nucleating aerosol of cool water droplets into the inlet zone of the heat exchanger is to substantially enhance the separation of product water from the atmospheric air stream, by promoting the initial attachment and condensation of water vapor onto finely dispersed seed nuclei.

In FIGS. 13 and 14, the structure and function of dehumidifying heat exchanger 75 is substantially similar to that previously described for the embodiments of FIGS. 1–7 inclusive. Product water separated from the atmospheric air stream passing through heat exchanger 75 is discharged from its drain outlet at 76, and flows into receiver 77 by way of any convenient channel means. Receiver 77 may be of any convenient size, and product water may be discharged from receiver 77 via conduit 78 and valve 79.

A minor fraction of product water discharged from heat exchanger 75 into receiver 77 may be recirculated through heat exchanger 75 during the operation of miniature pressure pump 82. Pump 82 receives recirculated product water from receiver 77 by way of conduit 80 and valve 81, and discharges pressurized water into conduit 83. Conduit 83 communicates between the outlet of miniature pressure pump 82 and the inlets of hydraulic atomizing nozzles 84, which are disposed within the air inlet section of heat exchanger 75 (at the right-hand side of FIGS. 13 and 14). A widely-dispersed fine aerosol of liquid water droplets is discharged into heat exchanger 75 from hydraulic atomizing nozzles 84, and is substantially carried into the heat exchanger within the entering air stream as suspended liquid particulate.

Extremely fine water droplets discharged at 85 within heat exchanger 75 act as cool seed nuclei which attract the attachment of water vapor molecules from within the moving air stream. Considerable condensation of water vapors onto cool seed nuclei may occur, and onto water droplets cascading from upper heat transfer tubes, before water droplets are electrostatically impelled onto surfaces of grounded or charged heat transfer conduits of the heat exchanger.

Figure 18:
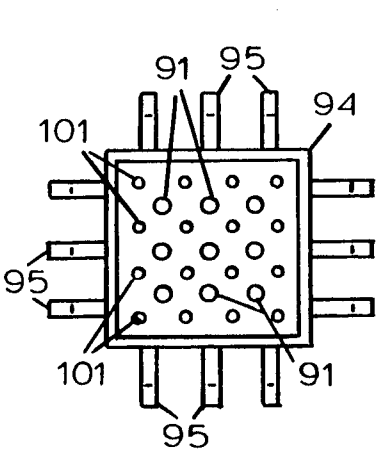
FIG. 18 is a transverse sectional view taken along line 4—4 of FIG. 16, showing the relative arrangement of electrode members and heat transfer conduits within ferromagnetic duct 94.
Figure 16:
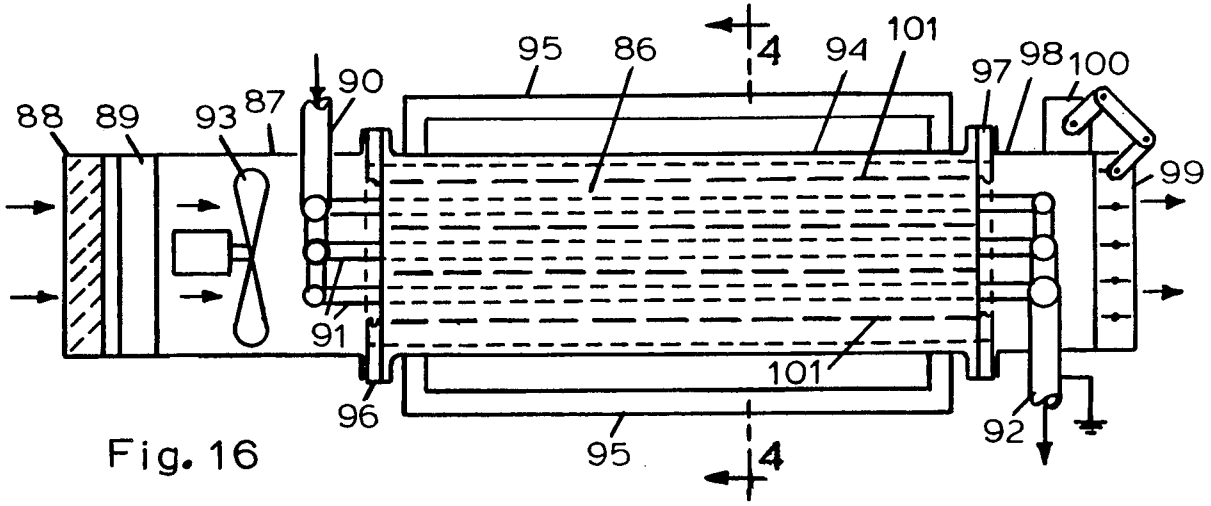
FIG. 16 is a partly sectional plan view of an unbaffled axial-flow type heat exchanger apparatus 86, whose heat transfer conduits pass through a ferromagnetic duct 94 having magnetic bridges 95 disposed between its inlet and outlet ends to accommodate an electrical field coil.
Figure 17:
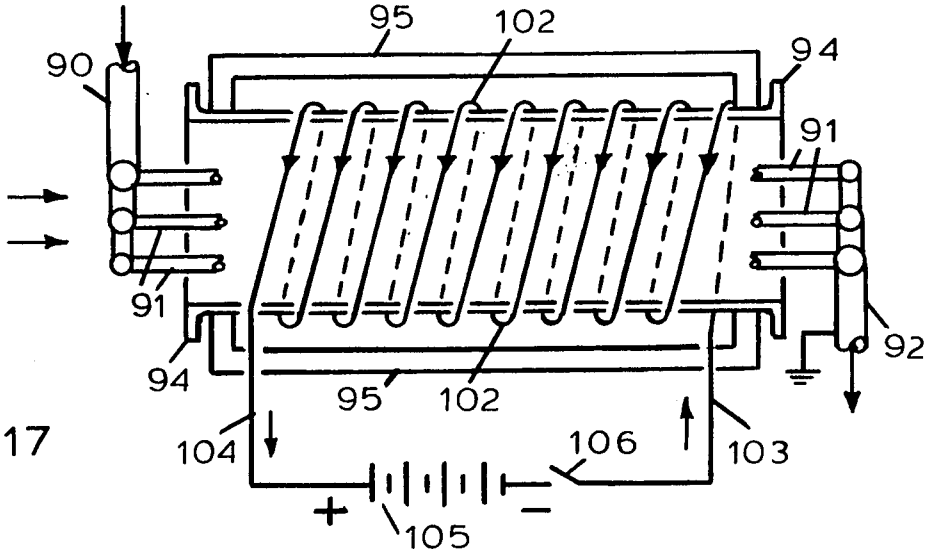
FIG. 17 is a fragmentary plan section of the ferromagnetic duct section 94 and heat transfer conduits 90,91,92 of FIG. 16, showing the electric circuit of an electrical field coil 102, which envelops the outer surface of the ferromagnetic duct within the magnetic bridges 95.

In the embodiments of FIGS. 16,17,18 an axial-type heat exchanger is disclosed in simplified form, which is adapted to employ both electric field forces and magnetic field forces in its central heat transfer section, to substantially increase water product extraction from a humid air stream passing through the apparatus. The heat exchanger apparatus includes a louvered air inlet section 87, a ferromagnetic heat transfer section 94, and an air outlet section 98 having an operable louver. The heat exchanger apparatus of FIGS. 16,17,18 may be horizontally declined, and include features such as tube sheets, baffles, absorbent drainage wicks, drainage means, nucleating aerosol injection, etc. such as described hereinbefore, but which are omitted to promote clarity of disclosure.

Air inlet section 87 includes inlet louver 88, filter 89, coolant supply conduits 90 and motor-driven fan 93. Motor-driven fan 93 would be operated at low-to-moderate speeds, to develop moderate air flow velocities within the ferromagnetic heat transfer section 94.

The central heat transfer conduit section is bounded by a ferromagnetic duct 94 having a plurality of ferromagnetic bridges 95 disposed about its outer periphery to communicate between its inlet and outer ends. Ferromagnetic bridges 95 provide a void space between their inlet and outlet end connections with duct 94, which accommodate an electrical field coil 102 (FIG. 17). The function of ferromagnetic bridges 95 is to provide efficient magnetic circuitry for the passage of magnetic flux between inlet and outlet ends of duct 94 (the permeability of ferromagnetic materials may be more than 100 times the permeability of air).

Electrically conducting heat transfer tubes 91 communicate between the grounded coolant supply and discharge conduits 90,92 and are centrally disposed within the ferromagnetic duct 94. Charged elongate electrodes 101 are disposed between and adjacent tubes 91 (FIG. 18), in tension between appropriate tube sheets (not shown), which are disposed adjacent the inlet and outlet flanges of duct 94. Insulating gaskets 96,97 are also disposed adjacent the inlet and outlet ends of duct 94 (FIG. 16), to limit leakage losses of electromagnetic flux.

Air outlet section 98 includes coolant discharge conduits 92 and operable louver 99. Coolant discharge conduits 92 are typically grounded by connection to an electrical ground between insulating flanges (not shown) disposed within the coolant supply conduits 92 upstream and downstream adjacent tubes 91 (such as shown in FIG. 12). Operable louver 99 is opened or closed by operation of damper operator 100 through appropriate mechanical linkage.

Referring to FIG. 17, an electrical field coil 102 is wrapped around the exterior surfaces of ferromagnetic duct 94 between the inlet and outlet shell connections of ferromagnetic bridges 95. Field coil 102 is energized by any suitable source of direct current 105, via conductors 103, 104 and switch 106. When switch 106 is closed, ferromagnetic duct effectively becomes the core of a tubular electromagnet having a strong magnetic flux (lines of magnetic force) within its internal cavity.

When a humid air stream flows through ferromagnetic duct 94 while high-voltage conductors 101 are negatively charged, the entire air stream becomes electrically conducting (or ionized). If field coil 102 is simultaneously energized, magnetic forces will be exerted on water vapor molecules in the air stream, causing the water vapor molecules to move laterally across fluid flow streamlines towards the nearest adjacent heat transfer tube 91, which will be described more fully hereinafter.

FIG. 19 schematically depicts a water molecule, wherein two hydrogen atoms are covalently bonded to an oxygen atom at an included angle between nuclei of about 105°. The unsymmetric structure of the water molecule results in a strong positive or North polar region adjacent the hydrogen pair, and a strong negative or South polar region oppositely adjacent the oxygen atom. Strongly polar water vapor molecules in a humid air stream passing through ferromagnetic duct 94 may be regarded as a swarm of minute magnets, which are susceptible to forces exerted by electric or magnetic fields.

Uncondensed water vapor molecules passing between negatively charged electrodes 101 and grounded heat transfer tubes 91 would be momentarily stabilized therebetween, with their positive or North poles oriented towards the nearest electrode 101, and their negative or South poles oriented towards the nearest surface point of a grounded heat transfer tube 91. Magnetic forces developed within the cavity of ferromagnetic duct 94 would then impel the water molecules inwardly from the sidewalls of duct 94 towards the nearest surfaces of grounded heat transfer tubes 91.

Magnetohydrodynamics is the study of phenomena arising from the motion of electrically conducting fluids in the presence of electric and magnetic fields. In the heat exchanger apparatus of FIGS. 16–18 inclusive, a humid air stream is ionized (made electrically conducting) by passing between high-voltage electrodes and grounded heat transfer tubes. Liquid particulates are charged during collision bombardment by energetic gas ions, then attracted to and collected on surfaces of grounded heat transfer tubes. Water vapor molecules are momentarily stabilized in polar orientation between high-voltage electrodes and the nearest adjacent surfaces of grounded heat transfer tubes. While electrostatic forces momentarily fix the water vapor molecules in polar orientation, magnetic forces impel the water vapor molecules across fluid flow streamlines onto the nearest surfaces of adjacent heat transfer tubes as thin condensing vapor films. Thusly, the synergistic combination of electrostatic and magnetic forces jointly act to substantially increase the water product extraction yield of the dehumidifying heat exchanger apparatus.

Potential usages of the apparatuses of the invention include:

(a) Dehumidification of humid atmospheric air to produce a potable water product, of great potential benefit to water-short regions of the earth.

(b) Dehumidification of atmospheric air within comfort air conditioning systems, with substantial reductions in cooling energy and heating energy loads.

(c) Vapor pollutant separation from exhaust gas streams in air pollution control system applications.

(d) Condensable vapor separation from gaseous streams in chemical process systems.

From the foregoing, it will be perceived by those skilled in the arts that the invention provides effective means for extraction of condensable vapors from gaseous streams in the apparatuses of the invention, and especially for the dehumidification of humid air streams with substantial energy economies.

While I have disclosed and described certain specific embodiments of the present invention, it will be readily understood by those skilled in the arts that I do not wish to be limited exactly thereto, since various modifications may be made without departing from the scope of the invention as defined in the appended claims.

I claim:

1. A method of concentrating and separating diffuse condensable vapors from a gaseous fluid flowing through a thin-film condensing heat exchanger, comprising the steps of:

a) injecting a nucleating aerosol of cool liquid droplets into the gaseous fluid, to provide liquid surfaces for attachment and condensation of vapor molecules within the gaseous fluid;

b) flowing the gaseous fluid past electrically-charged ionizing apparatus having one polarity;

c) electrostatically impelling the movement of liquid droplets and ionized condensing vapors from the said ionizing apparatus towards adjacent surfaces of grounded or oppositely-charged horizontally-declined heat transfer conduits of the said heat exchanger;

d) condensing vapor adjacent surfaces of the said horizontally-declined heat transfer conduits by cooling thin films of condensable vapor to below local site saturation and dew-point temperatures, as heat is transferred through the said horizontally-declined heat transfer conduits to a second cooler fluid;

e) absorbing condensate drainage from the said horizontally-declined heat transfer conduits into absorbent wicks attached thereto; and f) transferring condensate from the said horizontally-declined heat transfer conduits to an outlet of the said heat exchanger by drainage through the said absorbent wicks.

2. The method of claim 1 wherein the step of injecting the nucleating aerosol of cool liquid droplets includes:

a) pumping a recirculating fraction of the product liquid discharged from an outlet of the said heat exchanger through conduit means to an inlet of nozzle means;

b) expanding the recirculating fraction of product liquid through said nozzle means to a high-velocity low-pressure state; and c) discharging the recirculating fraction of product liquid into an inlet zone of the said heat exchanger as the said nucleating aerosol of cool liquid droplets.

3. The method of claim 1 wherein the step of condensing vapor by transferring heat through the said horizontally-declined heat transfer conduits to a second cooler fluid includes:

a) pumping the second cooler fluid through the said horizontally-declined heat transfer conduits, a second heat exchanger, and conduit branches of a closed-cycle heat transfer system; and b) rejecting heat from the said closed-cycle heat transfer system and the second cooler fluid through heat transfer conduits of the said second heat exchanger to a third cooler fluid.

4. The method of claim 1 wherein the step of condensing vapor by transferring heat through the said horizontally-declined heat transfer conduits to a second cooler fluid includes:

a) pumping the second cooler fluid through the said horizontally-declined heat transfer conduits, a second heat exchanger, and conduit branches of a closed-cycle heat transfer system; and b) rejecting heat from the said closed-cycle heat transfer system and the second cooler fluid through heat transfer conduits of the said second heat exchanger to evaporate a third cooler fluid circulating within conduit branches of vapor-compression refrigeration apparatus.

5. A method of concentrating and separating diffuse condensable vapors from a gaseous fluid flowing through a thin-film condensing heat exchanger, comprising the steps of:

a) injecting a nucleating aerosol of cool liquid droplets into the gaseous fluid, to provide liquid surfaces for attachment and condensation of vapor molecules within the gaseous fluid;

b) flowing the gaseous fluid past electrically-charged ionizing apparatus having one polarity;

c) electrostatically impelling the movement of liquid droplets and ionized condensing vapors from the said ionizing apparatus towards adjacent surfaces of grounded or oppositely-charged heat transfer conduits of the said heat exchanger;

d) condensing vapor adjacent surfaces of the said heat transfer conduits by cooling thin films of condensable vapor to below the local site saturation and dew-point temperatures, as heat is transferred through the said heat transfer conduits to a second cooler fluid, and e) transferring condensate from the said heat transfer conduits by cascading drainage from upper heat transfer conduits onto lower heat transfer conduits, and on to an outlet of the said heat exchanger.

6. The method of claim 5 wherein the step of injecting the nucleating aerosol of cool liquid droplets includes:

a) pumping a recirculating fraction of the product liquid discharged from an outlet of the said heat exchanger through conduit means into an inlet of nozzle means;

b) expanding the recirculating fraction of product liquid through the said nozzle means to a high-velocity low-pressure state; and c) discharging the recirculating fraction of product liquid into an inlet zone of the said heat exchanger as the said nucleating aerosol of cool liquid droplets.

7. The method of claim 5 wherein the step of condensing vapor by transferring heat through the said heat transfer conduits to a second cooler fluid includes:

a) pumping the second cooler fluid through the said heat transfer conduits, a second heat exchanger, and conduit branches of a closed-cycle heat transfer system; and b) rejecting heat from the said closed-cycle heat transfer system and the second cooler fluid through heat transfer conduits of the said second heat exchanger to a third cooler fluid.

8. The method of claim 5 wherein the step of condensing vapor by transferring heat through the said heat transfer conduits to a second cooler fluid includes:

a) pumping the second cooler fluid through the said heat transfer conduits, a second heat exchanger, and conduit branches of a closed-cycle heat transfer system; and b) rejecting heat from the said closed-cycle heat transfer system and the second cooler fluid through heat transfer conduits of the said second heat exchanger to evaporate a third cooler fluid circulating within conduit branches of vapor-compression refrigeration apparatus.

9. An electrostatically-enhanced condensing heat exchanger for transferring heat between a gaseous fluid having a condensable vapor fraction and a second cooler fluid, comprising in combination:

an outer shell enclosure having inlet and outlet means for confining flow of the first gaseous fluid therethrough, inlet and outlet means for confining flow of the second cooler fluid therethrough, and outlet means for discharging liquid condensate therefrom;

a fluid pump disposed to impel flow of the first gaseous fluid through the said enclosure;

a plurality of electrically-conducting heat transfer conduit means disposed within said enclosure in a spaced parallel array with horizontal and vertical separations between members thereof, and communicating between the corresponding said inlet and outlet means for the second cooler fluid;

elongate absorbent drainage wick conduit means whose upper portion is disposed lengthwise adjacent the lower outer surface of each member of the said plurality of electrically-conducting heat transfer conduit means at the vertical centerplane thereof, and within the said enclosure, while the discharge end of each absorbent drainage wick conduit means extends as an appendage below all of its respective adjacent electrically-conducting heat transfer conduit means, to discharge liquid condensate therefrom and on to said condensate outlet means of the said enclosure;

means defining and containing a supply of the second cooler fluid;

cooling means disposed within said supply means of the second cooler fluid;

conduit supply means communicating between the said cooling means for the second cooler fluid and the corresponding said inlet means of the said enclosure;

conduit discharge means for the second cooler fluid communicating with the corresponding said outlet means of the said enclosure;

means for supplying a nucleating aerosol of liquid droplets into the first gaseous fluid within an inlet zone of said heat exchanger enclosure, to provide diffused liquid surfaces for attachment onto and condensation of vapor molecules carried within the gaseous fluid;

gaseous electrostatic ionizing means comprising a plurality of charged elongate electrical conductors whose members are disposed longitudinally in a spaced alternate array between or adjacent members of the said plurality of electrically-conducting heat transfer conduit means within the said enclosure;

a source of direct electrical current communicating with the said plurality of elongate electrical conductors of the said gaseous ionizing means;

electrical insulating means disposed both within said conduit supply and conduit discharge means for the second cooler fluid, to electrically isolate the said electrically-conducting heat transfer conduit means within the said heat exchanger enclosure;

and electrical conductor means communicating with the said electrically-conducting heat transfer conduit means between members of the said electrical insulating means, and with an exterior electrical ground;

whereby members of the said plurality of electrically-conducting heat transfer conduit means become electrostatic collectors of liquid condensate droplets and ionized condensable vapor from the gaseous fluid flowing within the said heat exchanger enclosure.

10. The electrostatically-enhanced condensing heat exchanger of claim 9 wherein a second source of direct electrical current having opposite polarity from that of the first said source of direct electrical current is disposed to supply electrical current to said electrically-conducting heat transfer conduit means, and electrical conductor means communicating between said second source of direct electrical current and said electrically-conducting heat transfer conduit means; whereby members of the said plurality of electrically-conducting heat transfer conduit means become charged electrostatic collectors of liquid condensate droplets and ionized condensable vapor from the gaseous fluid flowing within the said heat exchanger enclosure.

11. The electrostatically-enhanced condensing heat exchanger of claim 9 wherein:

a liquid enclosure having inlet and outlet means is disposed to receive liquid condensate from lower appendages of the said absorbent drainage wick conduit means and the said drainage outlet means of said heat exchanger enclosure;

nozzle means are disposed within an inlet zone of the said heat exchanger enclosure to discharge a dispersed nucleating aerosol of fine liquid droplets into the gaseous fluid flowing therethrough;

a second fluid pump is disposed to discharge pressurized liquid condensate therefrom;

conduit means communicating between an outlet of the said liquid enclosure and an inlet of the said second fluid pump;

and conduit means communicating between an outlet of the said second fluid pump and an inlet of the said nozzle means;

whereby a fraction of liquid condensate discharged from said corresponding outlet means of said heat exchanger enclosure and into said liquid enclosure is pressurized by the said second fluid pump, and discharged from the said nozzle means into the gaseous fluid within an inlet zone of the said heat exchanger enclosure as a dispersed aerosol of fine liquid droplets, whose surfaces provide nucleating sites for the attachment onto and condensation of vapor molecules carried within the gaseous fluid.

12. The electrostatically-enhanced condensing heat exchanger of claim 9 wherein the said heat exchanger enclosure is secured by supporting means so that the said plurality of electrically-conducting heat transfer conduit means is horizontally declined, and hydrostatic pressure augments the drainage transfer of liquid condensate through the said attached elongate absorbent drainage wick conduit means from their higher portions to the lower portions thereof, and and liquid condensate drains from said elongate absorbent drainage wick conduit means into the corresponding said outlet means of the said heat exchanger enclosure.

13. An electrostatically-enhanced condensing heat exchanger for transferring heat between a gaseous fluid having a condensable vapor fraction and a second cooler fluid, comprising in combination:

an outer shell enclosure having inlet and outlet means for confining flow of the first gaseous fluid therethrough, inlet and outlet means for confining flow of the second cooler fluid therethrough, and outlet means for discharging liquid condensate therefrom;

a fluid pump disposed to impel flow of the first gaseous fluid through the said enclosure;

a plurality of electrically-conducting heat transfer conduit means disposed within said enclosure in a spaced parallel array with horizontal and vertical separations between members thereof, and communicating between the corresponding said inlet and outlet means for the second cooler fluid;

means defining and containing a supply of the second cooler fluid;

cooling means disposed within said supply means of the second cooler fluid;

conduit supply means communicating between the said cooling means for the second cooler fluid and the corresponding said inlet means of the said enclosure;

conduit discharge means for the second cooler fluid communicating with the corresponding said outlet means of the said enclosure;

means for supplying a nucleating aerosol of liquid droplets into the gaseous fluid within an inlet zone of said heat exchanger enclosure, to provide diffused liquid surfaces for attachment onto and condensation of vapor molecules carried within the gaseous fluid;

gaseous electrostatic ionizing means comprising a plurality of charged elongate electrical conductors whose members are disposed longitudinally in a spaced alternate array between or adjacent members of the said plurality of electrically-conducting heat transfer conduit means within the said enclosure;

a source of direct electrical current communicating with the said plurality of elongate electrical conductors of the said gaseous ionizing means;

electrical insulating means disposed both within said conduit supply and conduit discharge means for the second cooler fluid, to electrically isolate the said electrically-conducting heat transfer conduit means within the said heat exchanger enclosure;

and electrical conductor means communicating with the said electrically-conducting heat transfer conduit means between members of the said electrical insulating means, and with an exterior electrical ground;

whereby members of the said plurality of electrically-conducting heat transfer conduit means become electrostatic collectors of liquid condensate droplets and ionized condensable vapor from the gaseous fluid flowing within the said heat exchanger enclosure.

14. The electrostatically-enhanced condensing heat exchanger of claim 13 wherein a second source of direct electrical current having opposite polarity from that of the first said electrical conductor means to charge members of the said electrically-conducting heat transfer conduit means; whereby members of the said plurality of electrically-conducting heat transfer conduit means become charged electrostatic collectors of liquid condensate droplets and ionized condensable vapor from the gaseous fluid flowing within the said heat exchanger enclosure.

15. The electrostatically-enhanced condensing heat exchanger of claim 13 wherein:

a liquid enclosure having inlet and outlet means is disposed to receive liquid condensate drainage from the corresponding said outlet means of the said heat exchanger enclosure;

nozzle means are disposed within an inlet zone of the said heat exchanger enclosure to discharge a dispersed nucleating aerosol of fine liquid droplets into the gaseous fluid flowing therethrough;

a second fluid pump is disposed to discharge pressurized liquid condensate therefrom;

conduit means communicating between an outlet of the said liquid enclosure and an inlet of the said second fluid pump;.

and conduit means communicating between an outlet of the said second fluid pump and an inlet of the said nozzle means;

whereby a fraction of liquid condensate discharged from the corresponding said outlet means of said heat exchanger enclosure and into said liquid enclosure may be pressurized by the said second fluid pump, and discharged from the said nozzle means into the gaseous fluid within an inlet zone of the said heat exchanger enclosure as a dispersed aerosol of fine liquid droplets, whose surfaces provide nucleating sites for the attachment onto and condensation of vapor molecules carried within the gaseous fluid.

16. An electrostatically-enhanced condensing heat exchanger for transferring heat between a gaseous fluid having a condensable vapor fraction and a second cooler fluid, comprising in combination:

an outer shell enclosure having inlet and outlet means for confining flow of the first gaseous fluid therethrough, inlet and outlet means for confining flow of the second cooler fluid therethrough, and outlet means for discharging liquid condensate therefrom;

a fluid pump disposed to impel flow of the first gaseous fluid through the said enclosure;

a plurality of electrically-conducting heat transfer conduit means disposed within said enclosure in a spaced parallel array with horizontal and vertical separations between members thereof, and communicating between the corresponding said inlet and outlet means for the second cooler fluid;

means defining and containing a supply of the second cooler fluid;

conduit supply means communicating between the said supply means of the second cooler fluid and the corresponding said inlet means of the said enclosure;

conduit discharge means for the second cooler fluid communicating with the corresponding said outlet means of the said enclosure;

means for supplying a nucleating aerosol of liquid droplets into the gaseous fluid within an inlet zone of said heat exchanger enclosure, to provide diffused liquid surfaces for attachment onto and condensation of vapor molecules carried within the gaseous fluid;

gaseous electrostatic ionizing means comprising a plurality of charged elongate electrical conductors whose members are disposed longitudinally in a spaced alternate array between or adjacent members of the said plurality of electrically-conducting heat transfer conduit means within the said enclosure;

a source of direct electrical current communicating with the said plurality of elongate electrical conductors of the said gaseous ionizing means;

electrical insulating means disposed both within said conduit supply and conduit discharge means for the second cooler fluid, to electrically isolate the said electrically-conducting heat transfer conduit means within the said heat exchanger enclosure;

and electrical conductor means communicating with the said electrically-conducting heat transfer conduit means between members of the said electrical insulating means, and with an exterior electrical ground;

whereby members of the said plurality of electrically-conducting heat transfer conduit means become electrostatic collectors of liquid condensate droplets and ionized condensable vapor from the gaseous fluid flowing within the said heat exchanger enclosure.

17. The electrostatically-enhanced condensing heat exchanger of claim 16 wherein a second source of direct electrical current having opposite polarity from that of the first said source of direct electrical current communicates with the said electrical conductor means to charge members of the said electrically-conducting heat transfer conduit means; whereby members of the said plurality of electrically-conducting heat transfer conduit means become charged electrostatic collectors of liquid condensate droplets and ionized condensable vapor from the gaseous fluid flowing within the said heat exchanger enclosure.

18. The electrostatically-enhanced condensing heat exchanger of claim 16 wherein:

a liquid enclosure having inlet and outlet means is disposed to receive liquid condensate drainage from the corresponding said outlet means of the said heat exchanger enclosure;

nozzle means are disposed within an inlet zone of the said heat exchanger enclosure to discharge a dispersed nucleating aerosol of fine liquid droplets into the gaseous fluid flowing therethrough;

a second fluid pump is disposed to discharge pressurized liquid condensate therefrom;

conduit means communicating between an outlet of the said liquid enclosure and an inlet of the said second fluid pump;

and conduit means communicating between an outlet of the said second fluid pump and an inlet of the said nozzle means;

whereby a fraction of liquid condensate discharged from the corresponding said outlet means of the said heat exchanger enclosure and into said liquid enclosure may be pressurized by the said second fluid pump, and discharged from the said nozzle means into the gaseous fluid within an inlet zone of the said heat exchanger enclosure as a dispersed aerosol of fine liquid droplets, whose surfaces provide nucleating sites for the attachment onto and condensation of vapor molecules carried within the gaseous fluid.

19. An electrostatically-enhanced electromagnetically-enhanced condensing heat exchanger for transferring heat between a gaseous fluid having a condensable vapor fraction and a second cooler fluid, comprising in combination:

a ferromagnetic outer shell enclosure having inlet means and outlet means for confining flow of the gaseous fluid therethrough, inlet and outlet means for confining flow of the second cooler fluid therethrough, and outlet means for discharging liquid condensate therefrom;

said ferromagnetic enclosure having a plurality of ferromagnetic bridges distributed about its outer periphery which communicate between the inlet and outlet portions thereof, to complete a plurality of magnetic circuits therebetween;

each of said ferromagnetic bridge members separated from the said ferromagnetic enclosure between their magnetic end connections thereto;

a fluid pump disposed to impel flow of the gaseous fluid through the said ferromagnetic enclosure;

a plurality of electrically-conducting heat transfer conduit means disposed within said ferromagnetic enclosure in a spaced parallel array with horizontal and vertical separations between members thereof, and communicating between the corresponding said inlet and outlet means for the second cooler fluid;

means defining and containing a supply of the second cooler fluid;

conduit supply means communicating between the said supply means of the second cooler fluid and the corresponding said inlet means of the said ferromagnetic enclosure;

conduit discharge means for the second cooler fluid communicating with the corresponding said outlet means of the said ferromagnetic enclosure;

means for supplying a nucleating aerosol of liquid droplets into the gaseous fluid within an inlet zone of said heat exchanger, to provide diffused liquid surfaces for attachment onto and condensation of vapor molecules carried within the gaseous stream;

gaseous electrostatic ionizing means comprising a plurality of charged elongate electrical conductors whose members are disposed longitudinally in a spaced alternate array between or adjacent members of the said plurality of electrically-conducting heat transfer conduit means within the said ferromagnetic enclosure;

a source of direct electrical current communicating with the said plurality of elongate electrical conductors of the said gaseous ionizing means;

electrical insulating means disposed within both said conduit supply and conduit discharge means for the second cooler fluid, to electrically isolate the said electrically-conducting heat transfer conduit means within the said ferromagnetic enclosure;

electrical conductor means communicating with the said electrically-conducting heat transfer conduit means between members of the said electrical insulating means, and with an exterior electrical ground;

an electrical conductor having end terminals is disposed about the outer periphery of said ferromagnetic enclosure in a plurality of circumferential turns between members of the said plurality of ferromagnetic bridges and said ferromagnetic enclosure, to comprise an electrical field coil;

and a second source of direct electrical current communicating with said end terminals of the said electrical field coil;

whereby the said ferromagnetic enclosure comprises a tubular electromagnet which exerts magnetic forces within the internal cavity thereof, members of the said plurality of electrically-conducting heat transfer conduit means become electrostatic collectors of liquid condensate droplets and ionized condensable vapor, unattached condensable vapor molecules are electrostatically stabilized in polar orientation between adjacent conductors of said gaseous ionizing means and members of said grounded heat transfer conduit means, and unattached condensable vapor molecules electrostatically stabilized in polar orientation between conductors of said gaseous ionizing means and members of said grounded heat transfer conduits within the internal cavity of said ferromagnetic enclosure are impelled by magnetic forces onto surfaces of adjacent grounded heat transfer conduits as a thin film of condensing vapor, as the gaseous fluid flows through the said ferromagnetic enclosure of the said heat exchanger.

20. The electrostatically-enhanced electromagnetically-enhanced condensing heat exchanger of claim 19 wherein a third source of direct electrical current having opposite polarity from that of the first said source of direct electrical current communicates with the said electrical conductor means to charge members of the said electrically-conducting heat transfer conduit means; whereby members of the said plurality of electrically-conducting heat transfer conduit means become charged electrostatic collectors of liquid condensate droplets and ionized condensable vapor from the gaseous fluid flowing through the said heat exchanger.

21. The electrostatically-enhanced electromagnetically-enhanced condensing heat exchanger of claim 19 wherein:

a liquid enclosure having inlet and outlet means is disposed to receive liquid condensate drainage from the corresponding said outlet means of the said heat exchanger;

nozzle means are disposed within an inlet zone of the said heat exchanger to discharge a dispersed nucleating aerosol of fine liquid droplets into the gaseous fluid flowing therethrough;

a second fluid pump is disposed to discharge pressurized liquid condensate therefrom;

conduit means communicating between an outlet of said liquid enclosure and an inlet of the said second fluid pump;

and conduit means communicating between an outlet of the said second fluid pump and an inlet of the said nozzle means;

whereby a fraction of liquid condensate discharged from the corresponding said outlet means of the said heat exchanger and into said liquid enclosure may be pressurized by the said second fluid pump, and discharged from the said nozzle means into the gaseous fluid within an inlet zone of the said heat exchanger as a dispersed aerosol of fine liquid droplets, whose surfaces provide nucleating sites for the attachment onto and condensation of vapor molecules carried within the gaseous fluid.

22. An electrostatically-enhanced electromagnetically-enhanced condensing heat exchanger for transferring heat between a gaseous fluid having a condensable vapor fraction and a second cooler fluid, comprising in combination:

a ferromagnetic outer shell enclosure having inlet means and outlet means for confining flow of the gaseous fluid therethrough, inlet and outlet means for confining flow of the second cooler fluid therethrough, and outlet means for discharging liquid condensate therefrom;

said ferromagnetic enclosure having a plurality of ferromagnetic bridges distributed about its outer periphery which communicate between the inlet and outlet portions thereof, to complete a plurality of magnetic circuits therebetween;

each of said ferromagnetic bridge members separated from the said ferromagnetic enclosure between their magnetic end connections thereto;

a fluid pump disposed to impel flow of the gaseous fluid through the said ferromagnetic enclosure;

a plurality of electrically-conducting heat transfer conduit means disposed within said ferromagnetic enclosure in a spaced parallel array with horizontal and vertical separations between members thereof, and communicating between the corresponding said inlet and outlet means for the second cooler fluid;

members of the said plurality of electrically-conducting heat transfer conduit means disposed in a spaced relation with respect to each other to cascade liquid condensate droplets from surfaces of upper heat transfer conduits through the gaseous fluid and past lower heat transfer conduits, to provide dispersed liquid surfaces for attachment onto and condensation of vapor molecules carried within the gaseous fluid;

means defining and containing a supply of the second cooler fluid;

conduit supply means communicating between the said supply means of the second cooler fluid and the corresponding said inlet means of the said ferromagnetic enclosure;

conduit discharge means for the second cooler fluid communicating with the corresponding said outlet means of the said ferromagnetic enclosure;

gaseous electrostatic ionizing means comprising a plurality of charged elongate electrical conductors whose members are disposed longitudinally in a spaced alternate array between or adjacent members of the said plurality of electrically-conducting heat transfer conduit means within the said ferromagnetic enclosure;

a source of direct electrical current communicating with the said plurality of elongate electrical conductors of the said gaseous ionizing means;

electrical insulating means disposed within both said conduit supply and conduit discharge means for the second cooler fluid, to electrically isolate the said electrically-conducting heat transfer conduit means within the said ferromagnetic enclosure;

electrical conductor means communicating with the said electrically-conducting heat transfer conduit means between members of the said electrical insulating means, and with an exterior electrical ground;

an electrical conductor having end terminals is disposed about the outer periphery of said ferromagnetic enclosure in a plurality of circumferential turns between members of the said plurality of ferromagnetic bridges and said ferromagnetic enclosure, to comprise an electrical field coil;

and a second source of direct electrical current communicating with said end terminals of the said electrical field coil;

whereby the said ferromagnetic enclosure comprises a tubular electromagnet which exerts magnetic forces within the internal cavity thereof, members of the said plurality of electrically-conducting heat transfer conduit means become electrostatic collectors of liquid condensate droplets and ionized condensable vapor, unattached condensable vapor molecules are electrostatically stabilized in polar orientation between adjacent conductors of said gaseous ionizing means and members of said grounded heat transfer conduit means, and unattached condensable vapor molecules electrostatically stabilized in polar orientation between conductors of said gaseous ionizing means and members of said grounded heat transfer conduits within the internal cavity of said ferromagnetic enclosure are impelled by magnetic forces onto surfaces of adjacent grounded heat transfer conduits as a thin film of condensing vapor, as the gaseous fluid flows through the said ferromagnetic enclosure of the said heat exchanger.

23. The electrostatically-enhanced electromagnetically-enhanced condensing heat exchanger of claim 22 wherein a third source of direct electrical current having opposite polarity from that of the first said source of direct electrical current communicates with the said electrical conductor means to charge members of the said electrically-conducting heat transfer conduit means; whereby members of the said plurality of electrically-conducting heat transfer conduit means become charged electrostatic collectors of liquid condensate droplets and ionized condensable vapors from the gaseous fluid flowing through the said heat exchanger.

24. A method of concentrating and separating diffuse condensable vapors from a gaseous fluid flowing through a thin-film condensing heat exchanger, comprising the steps of:

a) injecting a nucleating aerosol of cool liquid droplets into the gaseous fluid, to provide liquid surfaces for attachment and condensation of vapor molecules within the gaseous fluid;

b) flowing the gaseous fluid past electrically-charged ionizing apparatus having one polarity;

c) electrostatically impelling the movement of liquid droplets and ionized condensing vapors from the said ionizing apparatus towards adjacent surfaces of grounded or oppositely-charged heat transfer conduits of the said heat exchanger;

stabilizing unattached vapor molecules in polar orientation between electrodes of said ionizing apparatus and adjacent surfaces of said grounded or oppositely-charged heat transfer conduits, by means of electrostatic field forces therebetween;

e) impelling movements of unattached vapor molecules which are electrostatically stabilized in polar orientations onto adjacent surfaces of said grounded or oppositely-charged heat transfer conduits as a thin film of condensing vapor, by means of electromagnetic field forces;

f) condensing vapor adjacent surfaces of said grounded or oppositely-charged heat transfer conduits by cooling thin films of condensable vapor to below local site saturation and dew-point temperatures, as heat is transferred through the said heat transfer conduits to a second cooler fluid; and g) transferring liquid condensate from said heat transfer conduits by drainage into an outlet of said heat exchanger.

25. The method of claim 24 wherein the step of injecting the nucleating aerosol of cool liquid droplets includes:

a) pumping a recirculating fraction of the product liquid discharged from an outlet of the said heat exchanger through conduit means to an inlet of nozzle means;

b) expanding the recirculating fraction of product liquid through said nozzle means to a high-velocity low-pressure state; and c) discharging the recirculating fraction of product liquid into an inlet zone of the said heat exchanger as the said nucleating aerosol of cool liquid droplets.

* * * * *